United States Patent [19]

Vigano

[11] Patent Number: 5,011,123

[45] Date of Patent: Apr. 30, 1991

[54] SYSTEM AND METHOD FOR COLLATING BOOK AND PAMPHLET SIGNATURES AND THE LIKE

[75] Inventor: Vittorio Viganó, Verdellino, Italy

[73] Assignee: Plastiver S.A.S. Di Giovanni e Vittorio Viganó & C., Ciserano-Zingonia, Italy

[21] Appl. No.: 337,227

[22] Filed: Apr. 12, 1989

[30] Foreign Application Priority Data

Apr. 13, 1988 [IT] Italy ..... 20187 A/88

[51] Int. Cl.[5] ..... B65H 39/02

[52] U.S. Cl. ..... 270/54; 270/52; 414/789

[58] Field of Search ..... 270/52, 53, 54, 55, 270/57, 58; 198/418.3; 414/789

[56] References Cited

U.S. PATENT DOCUMENTS 4,674,052 1/1987 Wong ..... 270/54

4,799,661 1/1989 Nail ..... 270/54

*Primary Examiner*—Edward K. Look

*Assistant Examiner*—Therese M. Newholm

*Attorney, Agent, or Firm*—Browdy and Neimark

[57] ABSTRACT

The invention claimed is directed to a signature collating system comprising stations (2) which are adapted to deliver signatures (3), as well as a transport (4) adapted to pick up the signatures (3) to form stacks (5), a diverting device (7) located downstream from the stations (2) and adapted to controllably convey the stacks (5) out of the transport (4), a reclaim belt (9*a*) extending from the diverting device (7), to a position of the transport (4) upstream of the stations (2), a signature (3) withdrawal station (9*b*) located on the reclaim belt (9*a*) and comprising a pull-out means (12) adapted to remove signatures (3) from the stacks (5), and a monitoring means (6) adapted to detect anomalies in the delivery of the signatures (3) and the positions of the stacks (5), and adapted to control the activation and deactivation of the stations (2), diverting device (7), and withdrawal station (9*b*).

23 Claims, 3 Drawing Sheets

SYSTEM AND METHOD FOR COLLATING BOOK AND PAMPHLET SIGNATURES AND THE LIKE

This invention relates to a system and a method for collating signatures for books, pamphlets, and the like.

As is known a signature is composed of one or more printed pages related to one another or joined together. A signature is typically a large-size printed sheet containing a number of pages and folded to a page size.

To form, for example, a book or a pamphlet, it is necessary to first collate and orderly stack several signatures from the printing shops.

This collating operation is carried out at bookbinding shops on collator systems which comprise a sequel of processing stations, referred to as "feeders", each arranged to deliver a given signature. Signatures being delivered consecutively by each station are orderly stacked together by a belt conveyor running past the feeder stations at a timed rate to the delivery rate of the stations. The belt conveyor practically picks up the signatures as they are being deposited to form orderly stacks or assemblies of signatures which grow in height as they are moved past the various stations.

The signature stacks or assemblies are transferred on completion, possibly at once and on that same belt conveyor, to a processing line placed downstream from the collating system, along which sewing, glueing, trimming, and binding proper are carried out, for example.

Each feeder station in the collating system is equipped with a means of detecting delivery of anomalies comprising of, for example, photocells or thickness gages as sensors, which can both detect the missed delivery of a signature and double delivery of one signature to any one stack.

Such monitoring means also stops the system in order for an operator to act as appropriate to correct the anomalous delivery.

The above-described prior art has major drawbacks. The signature collating system may have indeed to be stopped at frequent intervals, to accumulate an overall break time which may amount to as much as 40% of the overall working time.

This not only means a significant decrease in output but also increased wear of the equipment due to the frequent succession of starts and stops, as well as deterioration of the production quality due to the stacks or assemblies being at least in part disarranged by the inertiae brought about by the starts and stops. Attempts have already been made at partly solving the cited problems by keeping the system running and arranging a diverter downstream from the feeder stations and adapted to controllably direct stacks having any anomalies to a reject zone. In practice, the correction of anomalies by the operator has been replaced with rejection of anomalous stacks or assemblies in toto.

In this way, the problems due to frequent stopping of the system can be solved, but the material waste resulting from the rejected stacks is high.

In addition, albeit to a lesser extent, there still occurs a significant loss in output, because many of the signatures are rejected.

Thus, the technical problem remains unsolved of how to avoid frequent stops of the signature collating system without rejecting all those stacks which show anomalies.

It is the aim of this invention to provide a system and a method which can solce said technical problems and obviate the cited drawbacks.

The result is substantially achieved by a system for collating signatures for books, pamphlets, and the like, comprising: a plurality of consecutively arranged stations adapted to deliver said signatures, a transport adapted to pick up said signatures and take them to said stations to form growing stacks of said signatures, and a diverting device adapted to convey said stacks out of said transport, said system being characterized in that it has a reclaiming apparatus comprising: a reclaim belt extending from said diverting device to a position of said transport upstream of said diverting device and at least some of said stations, and a monitoring means effective to detect anomalies in the delivery of said signatures and the locations of said stacks affected by said anomalies, and effective to control the activation and deactivation of said stations, said diverting device being linked operatively to said monitoring means and operative to divert said stacks affected by anomalies toward said reclaim belt.

The system implements a method for collating signatures for books, pamphlets, and the like, which is characterized in that it comprises the steps of: detecting each anomaly including a missed delivery of one said signature at a station, and forming consecutive anomalous stacks involving a missed signature, detecting the positions progressively occupied by said anomalous stacks through said system, stopping each said station producing said anomalous stack moving on said transport, diverting said anomalous stacks out of said transport and subsequently re-loading of the same on said transport upstream of said previously stopped stations, and reactivating, just those stations which have missed delivery of signature to enable delivery of such missed signature to anomalous stacks reloaded onto said transport when such stacks move past such station.

The following description of the preferred embodiments of the invention are shown on the accompanying drawings, where:

Figure 1:
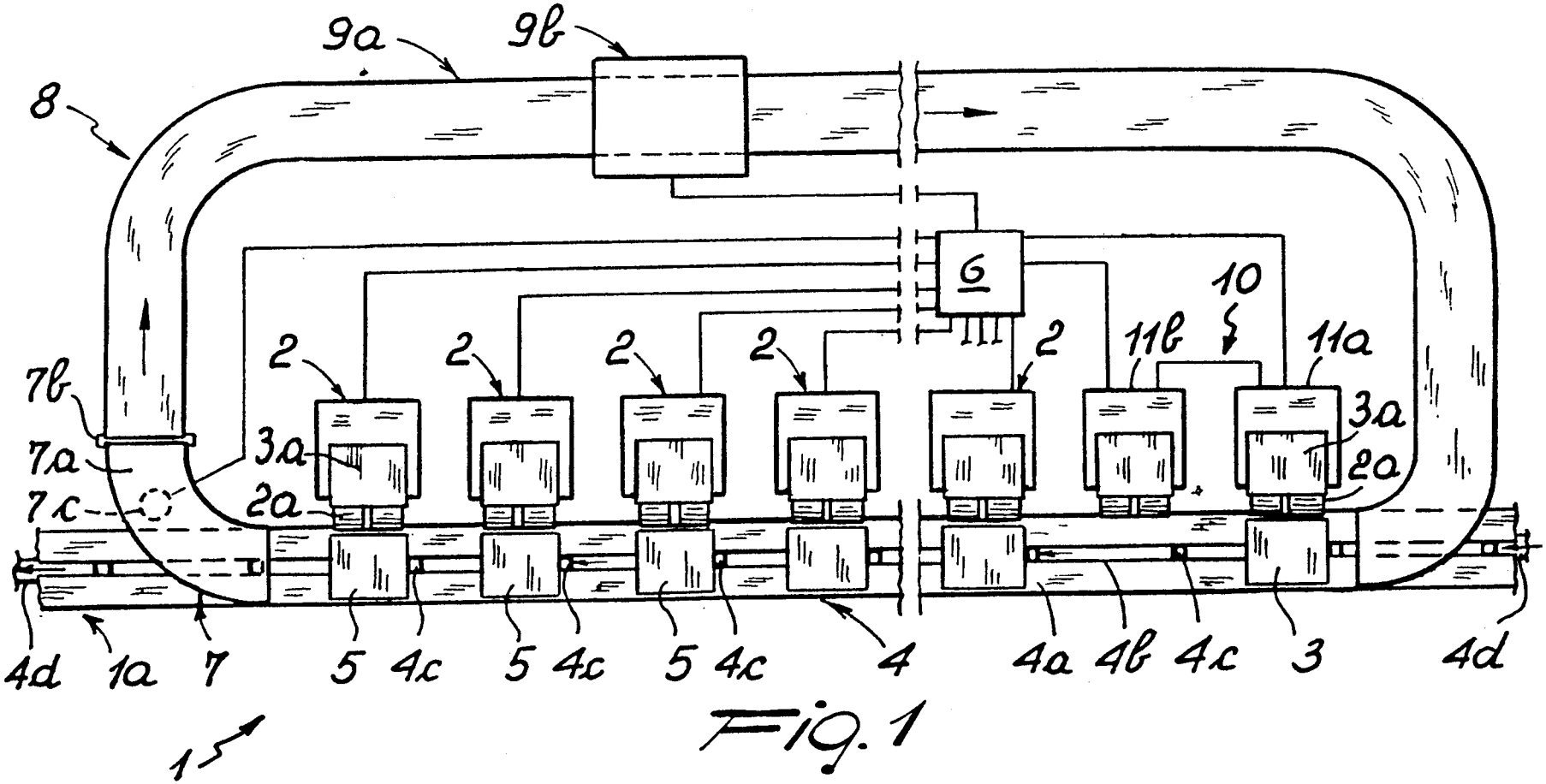
FIG. 1 shows schematically in plan view a system according to the invention, in an embodiment where many of its major components lie substantially within a horizontal plane.

With reference to the cited drawing views, the system of this embodiment of the invention is generally indicated at 1.

It comprises a plurality of consecutive stations 2, also referred to as feeder stations, on each of which stations signatures 3 are placed. The latter form, above the stations 2, piles 3*a*, each having signatures 3 which are identical with one another. The stations 2 are consecutively operative to deliver one signature 3 at a time onto an adjacent underlying transport 4. This is accomplished by large cylindrical drums 2*a* located between the piles 3*a* and the transport 4 and are rotatable about horizontal axes and equipped with grippers or suction cups which pick up and pull out the lowermost signature 3 in a pile 3*a*, and with the rotation of the drums, drop it in an orderly fashion onto the underlying transport 4, which extends belt-fashion.

The transport 4 has, in the embodiments shown, fixed guiding sideplates and a fixed rest and sliding bottom 4*a*.

Traveling centrally of the bottom 4*a* in a purposely provided guiding groove 4*b*, are pushers 4*c* which are spaced apart at a fixed pitch distance equal to the distance separating any two consecutive stations 2. It is envisaged, in fact, that the stations 2 be all arranged at equal spacings apart.

The pushers 4*c* are driven forward by a drive means preferably in the form of an entrainment chain 4*d*.

The signatures 3 are consecutively delivered to transport in superimposed arrangement to form successive stacks 5, each stack 5 comprising signatures 3 which are all different from one another and define a set of pages each which are not yet bound into a book or pamphlet or the like, for feeding to a successive processing path 1*a*.

Along said successive processing path there take place, in a consecutive manner for bookbinding shops, all the operations involved to complete said book or pamphlet, and in particular, binding of the various signatures 3 forming the stacks 5.

A monitoring means 6, associated with each feeder station 2 is then provided to detect, inter alia, anomalies in the formation of the signature 3 stacks 5, that is the missed delivery of a signature 3, or conversely, the double delivery of a signature 3.

The monitoring means 6 is preferably of an electronic type, and to detect and then issue the missed or double delivery signal, it comprises conventional photocells or thickness gages, for example, which monitors the withdrawal of signatures 3 from the piles 3*a* at each station 2.

The monitoring means 6 further monitors the movements of the stacks 5 where an anomaly has been detected, and interrupts or activates the delivery of a signature from various stations 2 when anomalous stacks involving such signatures and stations are detected and are moving past such stations.

The selective interruption of the infeed to just the anomalous stacks is effected by the monitoring means 6 by acting on the drums 2*a* of those stations 2 which are occasionally affected by the passage of anomalous stacks 5 without stopping the continuous movement of the transport 4, and starting with the next station 2 after the one where an anomaly has been detected.

Constant recognition of the positions progressively occupied by the anomalous stacks 5 can be readily obtained through the monitoring means 6 because the stacks 5 are rigorously held on the transport 4 at said fixed pitch distance spacings and the pushers 4*c* are all driven at a predetermined rate.

A diverting device 7 placed downstream from said feeder stations 2 is operative to prevent stacks 5 found anomalous from entering the aforesaid processing path 1*a* and to direct them to a reclaim apparatus 8 comprising a reclaim belt 9*a* which form, in combination with the transport 4, a looped travel path, and a withdrawal station 9*b* shown in greater detail in FIG. 3 described below.

The diverting device 7 is formed by a moving guide 7*a* adapted to be swung on a hinge 7*b* controllably by a lift cylinder 7*c* which lie substantially vertical and rests on the floor.

Figure 2:
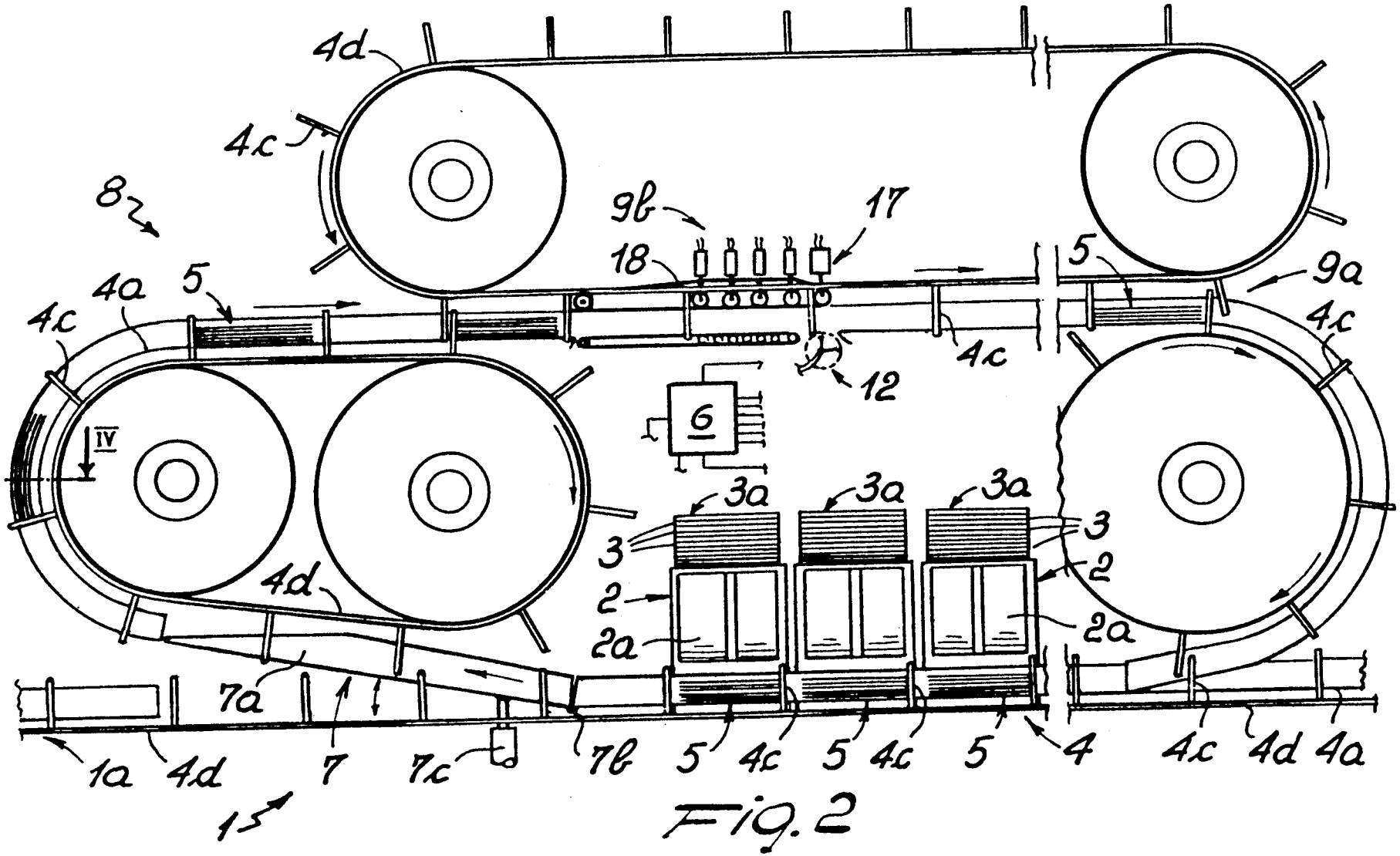
FIG. 2 is an elevation view of a system according to the invention in an embodiment where many of its major components lie substantially within a vertical plane.

In FIG. 1, the hinge 7*b* locates between the moving guide 7 and the reclaim belt 9*a*, whereas in the embodiment of FIG. 2, the hinge 7*b* is interposed to the moving guide 7*a* and the transport 4.

When diversion of a stack 5 is foreseen, the diverting device positions itself, under the action of the lift cylinder 7*c*, connector-fashion between the transport 4 and the reclaim belt 9*a*, and contrarywise, when a stack 5 is to be allowed to continue through the processing path 1*a*, the moving guide 7*a* is set not to hinder the transport 4.

This actually occurs, in the embodiment of FIG. 1, by raising the opposite end of the moving guide 7*a* from that engaged by the hinge 7*b*, whereas in the embodiment of FIG. 2, the moving guide 7*a* comes down to itself to form an end section for the transport 4.

The monitoring means 6 acts on the diverting device 7 via the lift cylinder 7*c*.

In the embodiment of FIG. 1, the elements of the system 1 are shown in plan view wherein the reclaim belt 9*a* is a carpet conveyor extending mainly in a horizontal plane, alongside the stations 2.

In the embodiment of FIG. 2, the system 1 is shows the reclaim belt 9*a* running in a substantially vertical plane or raised location above the stations 2 for reduced floor area requirements.

To also make the job easy for the monitoring means 6 at the reclaim belt 9*a*, it is envisaged that the latter be linked mechanically to the transport 4 in all its embodiments, so as to achieve reliable synchronization with the latter. FIG. 2 shows then that the reclaim belt 9*a* may be formed by a plurality of transport elements, all preferably provided with pushers 4*c* which are set apart at said fixed pitch distances equal to the distance separating any two consecutive stations 2. Like the transport 4, the pushers 4*c* of the reclaim belt 9*a* also fit in a guiding groove 4*b* having rigid edges, and those same pushers 4*c* are engaged with a drive means embodied by entrainment chains 4*d*.

The reclaim belt 9*a* defines a re-circulation path which re-loads the stacks 5 onto the transport 4, upstream of the stations 2, to allow for completion of each stack.

It is envisaged that the monitoring means 6 will detect anomalous stacks 5 which have been cycled back to the transport 4, and that, on their moving past, a station 2 and its corresponding feeder which was previously inhibited by a missed delivery will reactivate such station and feeder enabling delivery of the missed signature to the recycled stack.

Between the stations 2 there may then advantageously intervene at least one sister station 10 defined by a first sub-station 11*a* and a second sub-station 11*b*. The latter are practically two consecutive stations 2 which are loaded with signatures 3 of one type and interlocked with each other.

The monitoring means 6 only controls delivery of a signature 3 from the second sub-station 11*b* on detecting the missed delivery of the signature from the first sub-station 11*a*.

The previously mentioned withdrawal station 9*b* which is shown to be operative in both the embodiments of FIG. 1 and FIG. 2 is preferably located on the reclaim belt 9*a*, or possibly on the section of the transport 4 which immediately precedes the diverting device 7. Those stacks 5 which have double signatures 3, that is signatures twice delivered by mistake, are corrected therein by removal of the excess signatures 3, prior to their return to the transport 4. In an anomalous stack 5, the duplicate signature is the uppermost or lowermost one in the stack 5, because of the anomalous delivery having occurred last, on account of the action provided by the monitoring means 6 which interrupts any further deliveries to that stack 5.

Figures 3, 4:
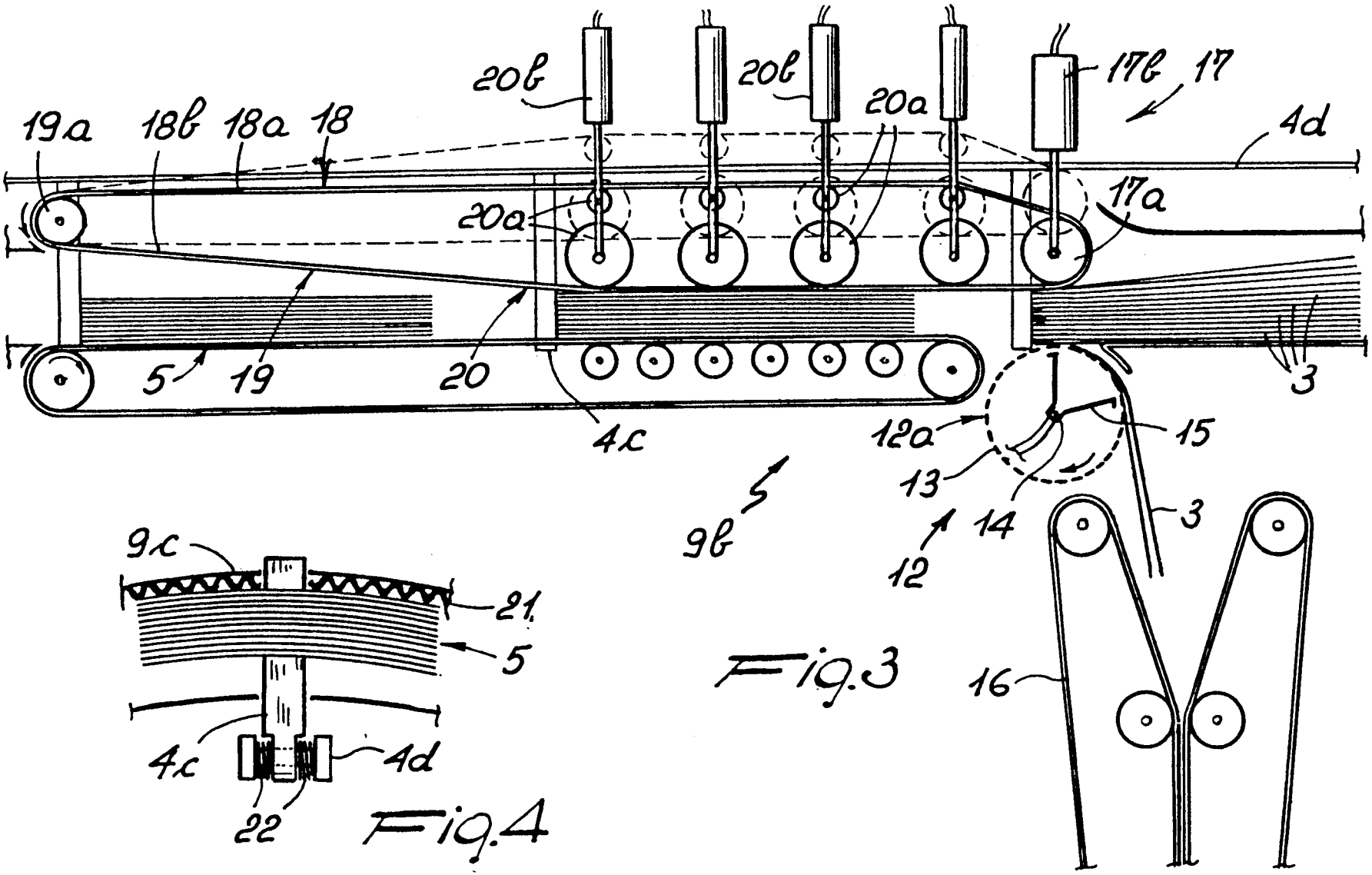
FIG. 3 is a detail view of a portion of the system shown in FIGS. 1 and 2, taken at a withdrawal station.
FIG. 4 is a sectional view taken along the line IV—IV in FIG. 2.

The withdrawal station 9*b* which is generally depicted in both FIGS. 1 and 2 and in operative detail in FIG. 3 comprises a pull-out means 12 having a body 12*a* which is provided with at least one, preferably two, side-by-side strips 13 which are separated by a groove for the pushers 4*c* to pass therethrough. The strips 13 are foraminous cylindrical strips which are rotatable and engageable in contact with signatures 3 to be pulled out. They are arranged, moreover, with their rotation axis 14 parallel to said signatures 3 to be removed.

Provided inside the body 12*a* are fixed suction members 15 facing the strips 13 but only engaging a sector of the body 12*a*. Thus, release of the signatures 3 drawn out is enabled on the latter being driven past the fixed suction members 14 by rotation of the strips 13.

The signatures 3 drawn out are taken away and discarded by a conveyor 16.

The withdrawal station 9*b* also comprises, on the opposite side from the body 12*a* relatively to a stack 5 positioned thereon, a pressure member 17 embodied by a pressure roller 17*a* lying parallel to the rotation axis 13*b* of the strips 13 and a pressure cylinder 17*b* acting on the pressure roller 17*a*.

The pressure cylinder 17*b* is advantageously effective to force, via the pressure roller 17*a*, the stacks 5 against the strips 13 until said stacks are partly spread out fan-like.

It is in fact a common experience that if a stack of sheets is pushed strongly across a local strip, the same fans out from the pressure point.

In this situation, owing to the pressure roller 17*a* exactly overlying the top of the body 12*a*, the spreading of the leading edges in the travel direction of the stacks 5 upon the same reaching the pull-out means 12 will encourage the signatures to part from one another and favor accurate withdrawal of the double signatures.

FIG. 3 shows that the pressure roller 17*a* is located in a closed-loop pressure belt 18 comprising major upper 18*a* and lower 18*b* runs. The pressure belt 18 is, similarly to the rollers inserted therein, divided into two side-by-side elements to enable the pushers 4*c* to pass therethrough.

The pressure belt 18 also has a lead-in portion 19 brought to a fixed position, lay roller 19*a*, and a working portion 20 which is movable in a vertical direction and adaptable to and engageable with the stacks 5 in pressure relationship therewith.

The working portion 20 has the distance between the upper 18*a* and lower 18*b* runs greater than the diameter of the lay roller 19*a*. In addition, the withdrawal station 9*b* has, at the working portion 20, auxiliary rollers 20*a* and auxiliary cylinders 20*b* which drive the working portion in the vertical direction by acting on both the upper run 18*a* and lower run 18*b*.

Such being the arrangement, the configuration of the pressure belt 18 can be held substantially constant, as brought out by a comparison of the dashed and full outlines of the pressure belt 18 in FIG. 3, thereby the position of the pressure roller 17*a* can also be held constant irrespective of the height of the stacks 5. Said height may, in fact, change appreciably because the feeding of the signatures 3 to the transport 4 may either occur directly beyond the first stations 2 or at the last stations 2.

FIG. 4 is a cross-section through FIG. 2 and shows that the reclaim belt 9*a* has, at least at its mainly vertically extending sections, an outline contour which is substantially saddle-shaped in cross-section for stiffening the stacks 5 in the vertical direction.

These saddle-shaped portions 9*c* produce, indeed, flexure lines in the signatures 3 of the stacks 5 which lie parallel to the direction of movement of the stacks 5, and therefore, the signatures 3 are prevented from flexing rearwards, toward their respective pushers 4*c*, by virtue of the powerful stiffening effect provided.

The stacks 5 can therefore travel even the vertical sections of the reclaim belt 9*a* without becoming upset.

Again with reference to FIG. 4, note should be taken of that the rest surfaces for the stacks 5 on the reclaim belt 9*a* may be provided with ribs 21 having parallel peaks to the direction of movement of the stacks 5 in order to reduce the contact, and hence the friction, with the bottom of the re-claim belt 9*a*.

It has been found that the ribs 21 also have the beneficial effect of creating air cushions at the bottoms of the stacks, with further reduction of friction.

Again as shown in FIG. 4, to prevent the various elements which comprise the re-claim belt 9*a* from interfering with one another and the transport 4, the pushers 4*c* are swivel mounted to the entrainment chain 4*d*, preferably against the bias of elastic means 22. Thus, by arranging the elastic means 22 and entrainment means consisting of an at least partly flexible entrainment chain, on the one side, and the guiding groove 4*b* with rigid edges, on the other side, the pushers 4*c* can be easily imparted any appropriate movements and oscillations.

The process and the structure of the invention, as provided in the above-described system, is as follows.

A first sensing step is provided at each station 2 to detect missing a delivery of a signature 3 or the delivery of a double signature 3.

The anomalous stacks 3 involving either a missed or double signature are then checked as a second step to detect their positions along transport 4. This enables stopping each station 2 when an anomalous stack 5 moves past, on transport 4. This permits, each station 2 to be inhibited or stopped when it would otherwise to deliver a signature 3 to an stack 5 moving past the station.

This is followed by a diversion step for diverting the anomalous stacks 5 out of the transport 4. This step preferably is carried out on the anomalous stacks 5 arriving downstream from all the stations 2 on transport 4. The diversion is followed by re-loading of the anomalous stacks 5 onto the transport 4, upstream of the previously stopped stations 2. Preferably the step of re-loading the anomalous stacks 5 is carried out when the stacks arrive upstream of all the feeder stations.

An additional step is provided for removal of a duplicate signature 3 from those anomalous stacks 5 having duplicate signatures prior to re-loading the corrected stack onto the transport 4.

The of removal is provided after the diversion step of the anomalous stacks out of the transport 4.

After re-loading onto the transport 4, the stacks 5 are again taken through the stations 2, and this time those stations 2 which were inhibited because of missed delivery are activated to deliver the appropriate signature 3 to the re-cycled stacks 5 moving past, having the missing signature.

In practice, only the previously stopped stations 2 are re-activated, if the anomaly that caused the stacks 5 to be cycled back was a double delivery, or those same stations 2 plus the station where the missed delivery took place, if the anomaly was of that type.

If the system has stations 2 at least partly paired, with each station pair provided with identical signatures 3, after the step of detecting an anomaly by missed delivery of a signature 3 at a first station in one said station pair, a step of activating a second station in said station pair is provided. This is done in order to reduce the number of the anomalies by missed delivery and avoid the need to recycle.

The operational pairing of the stations 2 is expedited each time that a given system has excess stations 2 with respect to the number of the signatures 3 to be delivered.

Furthermore, said pairing is quite useful even if only implemented at a limited number of stations, if the latter are selected from the ones delivering signatures 3 with physical features which are more likely to originate anomalies by missed delivery. The invention affords important advantages.

It enables, in fact, all of the anomalous stacks to be re-claimed, and the output rates to be kept practically unaltered. If all the stations are of the paired type, then it becomes possible to prevent the production of anomalous stacks by missing signatures, and accordingly, to temporarily divert them out of the belt conveyor 4, together with stacks having excess signatures.

In all cases, even with no paired stations provided, all the anomalous stacks by excess or lack of signatures can be re-claimed, and re-claiming is performed in a fast automatic manner and the transport 4 is never stopped. In fact, with the technical solutions set forth above, a top hourly production in the range of fifteen to twenty thousand finished stacks is actually achievable.

I claim:

1. A system for collating signatures for books, pamphlets, and the like, comprising: a plurality of consecutively arranged stations (2) adapted to deliver said signatures (3), a transport (4) adapted to pick up said signatures (3) and take them from said stations (2) up said growing stacks (5) of said signatures (3), and a diverting device (7) adapted to convey said stacks (5) out of said transport (4), said system being characterized in that it has a reclaiming apparatus comprising:

a reclaim belt (9*a*) extending from said diverting device (7) to a position of said transport (4) upstream of said diverting device (7) and at least some of said stations (2), and a monitoring means (6) effective to detect anomalies in the delivery of said signatures (3) and the locations of said stacks (5) affected by said anomalies, and effective to control the activation and deactivation of said stations (2), said diverting device (7) being linked operatively to said monitoring means (6) and operative to divert said stacks (5) affected by anomalies toward said reclaim belt (9*a*).

2. A system according to claim 1, wherein a signature (3) withdrawal station (9*b*) is linked operatively to said monitoring means (6) and located downstream from said stations (2) in the direction of movement of said stacks (5), along a closed loop path defined by said transport (4), said diverting device (7), and said reclaim belt (9*a*), said withdrawal station (9*b*) including a pull-out means (12) operative to remove signatures (3) located at one end of said stacks (5).

3. A system according to claim 2, wherein said pull-out means (12) comprises a body (12*a*) having at least one foraminous cylindrical strip (13) which is rotatable and contact engageable by said signatures (3), said strip (3) having an axis of rotation (14) parallel to said signatures (3), and fixed suction members (15) positioned inside said body (12*a*) and facing a portion of said strip (13).

4. A system according to claim 3, wherein a pressure member (17) is arranged in said withdrawal station (9*b*) on the opposite side from said body (12*a*) relatively to said stacks (5), said pressure member (17) having a pressure roller (17*a*) parallel to said rotation axis (14) of said strip (13) and a pressure cylinder (17*b*) adapted to force, via said pressure roller (17*a*), said stacks (5) against said strip (13) until said stacks (5) are partly spread out fan-like.

5. A system according to claim 4, wherein a pressure belt (18) is provided with said pressure roller (17*a*), said pressure belt (18) being loop-shaped and comprising a major upper run (18*a*) and lower run (18*b*), a lead-in portion (19) accommodating a fixed position lay roller (19*a*) at one end, and a working portion (20) which is movable and pressure engageable with said stacks (5), auxiliary rollers (20*a*) and auxiliary cylinders (20*b*) being arranged to shift said working portion (20).

6. A system according to claim 5, wherein said pressure belt (18) has said upper (18*a*) and lower (18*b*) runs at a greater distance apart than the diameter dimension of said lay roller (19*a*), and wherein said auxiliary rollers (20*a*) act on both said upper (18*a*) and lower (18*b*) runs to keep the length of said pressure belt (18) constant in the direction of advance of said stacks (5) and in constant the in position of said pressure roller (17*a*), located at one end of said pressure belt (18) opposite from that engaged by said lay roller (19*a*).

7. A system according to claim 1, wherein said diverting device (7) is located downstream from all said stations (2) in the direction of movement of said stacks (5) as imparted by said transport (4), and wherein said reclaim belt (9*a*) extends from said diverting device (7) to a position of said transport (4) upstream of all said stations (2).

8. A system according to claim 1, wherein said diverting device (7) comprises a movable guide (7*a*) adapted to be joined with one end to said transport (4) and with the other end to said reclaim belt (9*a*), at least one hinge (7*b*) engaging one end of said movable guide (7*a*) to make the movable guide (7*a*) swingable between a position of interconnection of said transport (4) and said reclaim belt (9*a*) and an offset position therefrom, and a lift cylinder (7*c*) acting on said movable guide (7*a*) to angularly displace the same about at least said one hinge said (7*b*).

9. A system according to claim 1, wherein said reclaim belt (9*a*) lies in a substantially raised position above said transport (4).

10. A system according to claim 9, wherein said reclaim belt (9*a*) has, at least at mainly vertically extending sections, saddle-shaped portions (9*c*) having a curving contour in cross-section to the direction of movement of said stacks (5) to bend and stiffen said signatures (3).

11. A system according to claim 1, wherein said reclaim belt (9*a*) has a surface contacting said stacks (5)

formed at least partway with ribs (21) having parallel peaks to the direction of movement of said stacks (5).

12. A system according to claim 1, wherein said stations (2) are and equispaced, and wherein said transport (4) and said reclaim belt (9*a*) comprise a drive means (4*d*) and pushers (4*c*) engaged with said drive means (4*d*) and being set apart at fixed pitch distances equal to the distance separating any two consecutive said stations (2), and wherein at least said pushers (4*c*) of said reclaim belt (9*a*) are engaged oscillatingly by said drive means (4*d*), a guiding groove (4*b*) with rigid edges being arranged to position said pushers (4*c*).

13. A system according to claim 1, wherein said stations (2) comprise at least one said station of the paired type (10) comprising first (11*a*) and second (11*b*) consecutively arranged substations adapted to alternately deliver identical signatures (3).

14. A method for collating signatures for books, pamphlets, and the like in a system comprising serially arranged stations delivering said signatures, and a transport adapted to pick up said signatures and take them to said stations to form stacks of said signatures, said method being characterized in that it comprises the steps of:

detecting each anomaly by missed delivery of one said signature at one said station, and forming consequently anomalous stacks by lack of one said signature, detecting the positions progressively occupied by said anomalous stacks through said system, stopping each said station on one said anomalous stack moving past on said transport, diverting said anomalous stacks out of said transport and subsequently re-loading of the same on said transport upstream of said previously stopped stations, and activating, on said anomalous stacks re-loaded onto said transport moving past, just those stations which have missing signatures from said re-loaded stacks.

15. A method according to claim 14, wherein there is provided a step of detecting each anomaly by both missed delivery of one said signature and double delivery of one said signature, and consequently forming anomalous stacks by both lack of one said signature and presence of a duplicate signature, and wherein, for those of said stacks which are anomalous by the presence of a duplicate signature, there is provided an additional step of removing said duplicate signature prior to said anomalous stacks being re-loaded onto said transport.

16. A method according to claim 14, wherein said step of diverting said anomalous stacks out of said transport is carried out on the same arriving downstream from all said stations in the running direction of said transport, and wherein said step of re-loading said anomalous stacks is carried out on the same arriving upstream of all said stations.

17. A method according to claim 15, wherein said step of removing said double signatures is carried out after said step of diverting said anomalous stacks out of said transport.

18. A method according to claim 14, in a system having at least some of said stations grouped into pairs having identical signatures, wherein after a step of detecting an anomaly by missed delivery of a signature at a first station in one said station pair, there is provided a step of activating a second station in said station pair.

19. A method for collating signatures for books, pamphlets, and the like in a system comprising consecutively arranged stations delivering said signatures, and a transport adapted to pick up said signatures and take them from said stations to form stacks of said signatures, said method comprising detecting each anomaly involving a missed delivery of a signature at one said station, and forming consecutively anomalous stacks involving a missed signature;

detecting the positions progressively occupied by said anomalous stacks through said system;

stopping each said station producing said anomalous stack moving on said transport;

diverting said anomalous stacks out of said transport and subsequently re-loading of said anomalous stacks on said transport upstream of said previously stopped stations; and reactivating just those stations which have missed delivery of a signature to enable delivery of said missed signature to anomalous stacks reloaded onto said transport when said stacks move past said station.

20. A method according to claim 19, further comprising a step of detecting both missing a delivery of one said signature or the double delivery of one said signature, and consequently forming anomalous stacks involving either a missed or double signature, and an additional step of removing a duplicate signature from those anomalous stacks having duplicate signatures prior to said anomalous stack being re-loaded onto said transport.

21. A method according to claim 19, wherein said step of diverting said anomalous stacks out of said transport is carried out on the same arriving downstream from all said stations in the running direction of said transport, and wherein said step of re-loading said anomalous stacks is carried out on the same arriving upstream of all said stations.

22. A method according to claim 20, wherein said step of removing said double signatures is carried out after said step of diverting said anomalous stacks out of said transport.

23. A method according to claim 19, in a system having at least some of said stations grouped into pairs having identical signatures, wherein after a step of detecting an anomaly by missed delivery of a signature at a first station in one said station pair, there is provided a step of activating a second station in said station pair.

* * * * *